US005823803A

United States Patent [19]

Majors

[11] Patent Number: 5,823,803

[45] Date of Patent: Oct. 20, 1998

[54] ELECTRICAL CABLE CONNECTOR

[75] Inventor: Brian C. Majors, Naperville, Ill.

[73] Assignee: Conxall Corporation, Villa Park, Ill.

[21] Appl. No.: 668,043

[22] Filed: Jun. 17, 1996

[51] Int. Cl.[6] ..... H01R 4/66

[52] U.S. Cl. ..... 439/98

[58] Field of Search ..... 439/98, 610, 585

[56] References Cited

U.S. PATENT DOCUMENTS

| | | | |
|---|---|---|---|
| 3,539,976 | 11/1970 | Reynolds . | |
| 3,739,076 | 6/1973 | Schwartz . | |
| 4,580,862 | 4/1986 | Johnson | 439/585 |
| 4,710,138 | 12/1987 | Bradley et al. | 439/886 |
| 4,755,152 | 7/1988 | Elliot et al. . | |
| 4,898,173 | 2/1990 | Daglow et al. | 439/585 |
| 4,921,447 | 5/1990 | Capp et al. | 439/585 |
| 4,941,850 | 7/1990 | Ankers et al. | 439/585 |
| 4,990,106 | 2/1991 | Szegda . | |
| 5,127,843 | 7/1992 | Henry et al. . | |
| 5,217,393 | 6/1993 | Del Negro et al. . | |
| 5,338,225 | 8/1994 | Jacobsen et al. . | |

FOREIGN PATENT DOCUMENTS

| | | |
|---|---|---|
| 2427189 | 6/1974 | Germany . |

*Primary Examiner*—Larry I. Schwartz
*Assistant Examiner*—Christopher Goins
*Attorney, Agent, or Firm*—Mayer, Brown & Platt

[57] ABSTRACT

What is disclosed is a electrical cable connector to shield against EMI, ESD and EMC emissions. The cable connector is used to connect an electrical cable to a mating connector having an integral connecting mechanism such as a threaded exterior surface. The cable has a cable jacket surrounding a braid which surrounds at least one signal lead. The cable jacket is removed over a portion of the cable to expose the braid. The exposed braid is then folded back over the cable jacket to create a braid surface. A coupling ring, which has an integral coupling mechanism such as a threaded interior surface, is placed over the end of the cable. A shield is placed in the coupling ring and a portion of the shield is crimped over the braid surface. An optional wave spring may be placed between the coupling ring and the shield. An insulating insert is placed between the end of the one cable and the mating connector. The coupling ring is screwed onto the mating connector. The connector thus has electrical continuity between the braid, the cylindrical shield and the coupling ring to shield against EMI, ESD and EMC emissions.

17 Claims, 3 Drawing Sheets

ELECTRICAL CABLE CONNECTOR

FIELD OF INVENTION

This invention relates to a connector for electrical cable assemblies. Particularly, this invention is directed to connectors configured to provide EMI, ESD and EMC shielding.

BACKGROUND OF INVENTION

Electrical connectors and cable assemblies play an integral role in numerous electrical devices. For example, these electrical connectors and cable assemblies are typically incorporated in vehicles, manufacturing equipment, computers, entertainment devices, medical and life support systems, and a variety of other electrically operated equipment. Typically, such connectors couple different components together via a cable to transmit electrical signals. The cables and the connectors must isolate the multiple electrical leads which carry the signals and the connectors must also ensure that a "solid" electrical connection is provided from the electrical leads in a cable to a device or another cable.

A common problem associated with the use of electrical connectors and cable assemblies is interference created by electro-magnetic interference (EMI), electro-static discharge (ESD) and electro-magnetic compatibility (EMC) emissions. These emissions generally emanate from sources such as other electrical devices, power supplies and the like located near or adjacent the electrical connectors. These emissions may be particularly inconvenient, and perhaps even harmful or life-threatening, when the resulting interference disrupts, distorts, or otherwise affects or prevents operation of the associated equipment. For example, with regard to signal transmission for audio or video signals, such emissions may interfere with the signal resulting in degraded sound or pictures. With regard to medical diagnostic instruments, the results may be of far greater concern, particularly if the interference results in inaccurate readings from degraded signals to the diagnostic equipment.

The leads in the cables therefore should be shielded against such emissions in the environment around and near the cables. Conversely, it is also desirable that signals be shielded from emissions from the cable and that the shield prevent or reduce emissions from emanating from the cable. Electrical overloading such as electrical surges or lightning also may result in improper operation or destruction of the electrical connector and the cable connections.

A variety of devices and methods have been developed in an attempt to reduce or eliminate undesirable EMI or EMC emissions. These known devices and methods generally incorporate various configurations of metal parts, such as metal shells and braided metal cable sleeves, to facilitate shielding. Such known devices, however, have only been used for single lead cables such as coaxial cable. Although oftentimes effective for the purpose of shielding, the required connection between the various metal parts are often difficult to fabricate, thus resulting in increased costs and weight. In addition, due to the difficulty in manufacture, many of these known devices are not completely shielded, either from emissions near the cable connector or emissions from the connector area itself.

Thus, there exists a need for a shielded electrical connector that is effective to shield from and to eliminate undesirable EMI and EMC emissions and to reduce or eliminate ESD but easy to manufacture and simple to assemble. In particular, there further remains a need for a shielded electrical connector that can be used with multiple lead cables.

SUMMARY OF INVENTION

In accordance with the present invention, a connector is provided for connecting a cable to a tubular mating connector, such as for example a cylindrical mating connector, having at least one electrical lead and a threaded, bayonet, twist lock, quick disconnect exterior or other coupling mechanism. The cable has a cable jacket surrounding a braid, with the cable also having at least one electrical lead with an insulating layer surrounding a wire which is contained within the braid. The cable connector has a coupling ring with an interior surface to mate with a counterpart connector. When assembled, the braid is folded over the cable jacket and the cable connector is initially assembled around the cable. The coupling ring is positioned around the exterior surface of the mating connector to connect the mating connector with the cable. A shield, preferably cylindrical in shape, is placed within the coupling ring and crimped around the braid of the cable so as to be in electrical contact with the braid. An optional wave spring is positioned in electrical contact between the coupling ring and the cylindrical shield. An insulating insert, preferably cylindrical in shape, is placed within the shield and surrounds each electrical lead of the cable.

It is an object of the present invention to provide a shielded electrical connector to eliminate undesirable EMI, ESD and EMC emissions.

It is another object of the present invention to provide an electrical connector that is simple to manufacture.

Yet another object of the present invention is to provide an electrical connector that may be used for a variety of different diameter cables having various numbers of electrical leads.

This invention also contemplates other features and advantages which will become more fully apparent from the following detailed description taken in conjunction with the accompanying drawings where identical elements have like reference numerals.

DESCRIPTION OF THE PREFERRED EMBODIMENT

Figure 1:
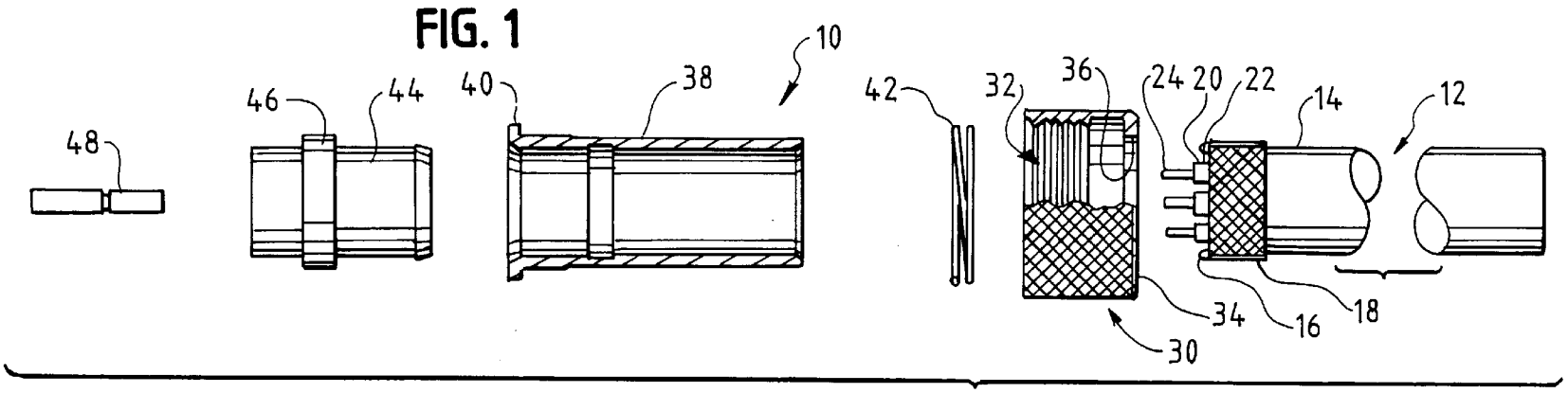
FIG. 1 is an exploded view of a representative embodiment of the novel connector of the present invention in combination with a cable.
Figure 2:
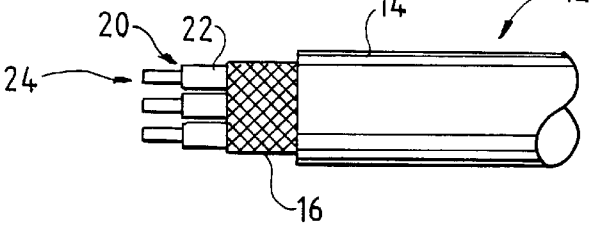
FIG. 2 is a side view of a cable that may be connected by the connector shown in FIG. 1.

FIG. 1 shows an exploded view of a cable connector 10 according to the present invention. The cable connector 10 is to be installed on one end of a shielded cable 12. FIG. 2 is a side view of one end of cable 12 before attaching connector 10. Cable 12 has a cable jacket 14, which is an insulator material such as, for example, plastic or rubber.

The cable jacket 14 surrounds a braid 16, such as wire mesh or circumferencially laid foil or a combination of both. The braid 16 serves as a shield against EMI, ESD and EMC emissions for the cable 12. The braid 16 is typically stainless steel, aluminum or tinned copper although other conductive materials may be used.

The braid 16 surrounds a number of signal leads 20. In this example, cable 12 has three signal leads although cables with any number of signal leads may be used in conjunction with the connector 10. Each signal lead 20 includes a wire 24 surrounded by an insulation layer 22. The wires 24 are made of a conductive material, such as copper, to carry the electrical signals.

Figure 3:
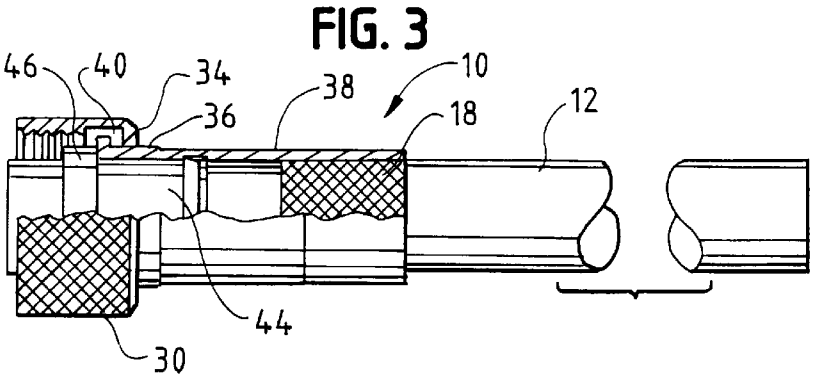
FIG. 3 is the assembled connector of FIG. 1 installed on the cable of FIG. 2.

With reference to FIG. 1 and FIG. 3, the latter of which shows the assembled connector 10, the cable 12 is prepared by stripping the cable jacket 14 away for a certain length exposing the braid 16. The exposed length of braid 16 is folded back over the cable jacket 14 to create a braid contact surface 18 over the entire outer perimeter of the cable jacket 14.

The connector 10 includes a coupling ring 30, a tubular shield 38, a wavespring 42, and a tubular insulating insert 44. As depicted in FIG. 1 and FIG. 3, the coupling ring 30, which has a coupling mechanism such as a threaded interior surface 32, is fit around the cable 12. Other coupling mechanisms such as bayonet type, twist lock type, or quick disconnect configuration may be used in conjunction with coupling ring 30 instead. The coupling ring 30 has an open end and a retaining wall 34 which is located opposite the open end. The retaining wall 34 has an opening 36 with a sufficient size to permit one end of the cable 12 to be inserted through the coupling ring 30. The opening 36 is preferably consistent in shape with the shape of the cable 12 and in the embodiment depicted is a circular opening. The coupling ring 30 is made of aluminum and electroless nickel plating in the preferred embodiment, although other lightweight metals or metallic components may be used for the coupling ring 30.

A tubular shield 38, preferably with a cylindrical configuration, having an interior size which is just larger than the exterior size of the cable 12, is also provided. The interior size of the shield 38 allows the shield 38 to fit snugly over the exposed length of braid 16 that is folded over the jacket 14 of cable 12. The shield is then crimped 360° around its perimeter for secure contact with the braid contact surface 18 and sealing engagement with the jacket 14. In this manner, an electrical contact is created between the interior surface of the shield 38 and the contact surface 18 of the braid 16 after the 360° crimp. Because the braid surface 18 is folded over the entire surface of the jacket 16 and thereafter crimped, electrical contact may be established substantially around the interior surface of the shield 38. Various 360° crimping methods utilizing variable types and sizes of dies creating multiple indents along the braid surface 18 may be used. For example, a hose crimping device available from Imperial Eastman Kwikrimp of Manitowac, Wis. as Model K16 may be modified to provide the desired crimp diameter in accordance with the invention. The various 360° crimp variations provide environmental sealing and mechanical retention between the cable 14 and the connector 10. Shielding provided by the braid 16 is continued by the connector 10 as will be explained below.

When the shield 38 is cylindrical in shape, the outer diameter of the shield 38 is smaller than the diameter of the circular opening 36 of the coupling ring 30, thus allowing the shield 38 to be inserted through the coupling ring 30 prior to crimping. The shield 38 includes a flared lip 40 having a size larger than the size of the circular opening 36 of the coupling ring 30, which advantageously serves as a stopper against axial movement of the retaining wall 34 relative to the coupling ring 30 while allowing rotational movement therebetween. The shield 38 is made of aluminum and electroless nickel plating in the preferred embodiment, although other lightweight metals or metallic components may also be used.

An optional spiral wave spring 42 may also be located around the outer surface of the shield 38. The spiral wave spring 42 buffers the flared lip 40 of the shield 38 and the retaining wall 34 of the coupling ring 30. In the preferred embodiment, the spiral wave spring 42 is a carbon spring/stainless steel with or without electroless nickel plating to enhance conductivity and retard corrosion.

The connector 10 is also provided with an insulating insert 44, which is preferably cylindrical is shape. As shown in FIG. 1, the insulating insert 44 has an outer diameter to allow the insulating insert 44 to be fit snugly within the interior of the shield 38. The insulating insert 44 has a stopper 46 on its exterior surface which abuts the flared lip 40 of the shield 38. Provided within the insulating insert 44 are pin-socket contacts 48 corresponding in number to the leads 20 of the cable 12. The insulating insert 44 serves to insulate the leads 20 of the cable 12. The insulating insert 44 in this embodiment is made of polyurethane, although any insulating material may be used.

Each of the signal leads 20 of the cable 12 are stripped of their insulation layers 22 to expose the wires 24. Each wire 24 is connected to a corresponding pin-socket contact 48 (see FIG. 5) by soldering, welding or other known means. Each pin-socket contact 48 is made of brass and is gold plated in the preferred embodiment although any sturdy conducting material may be substituted for the pin-socket contact 48. Other wire connectors may likewise be used for pin-socket contact 48.

Figure 4:
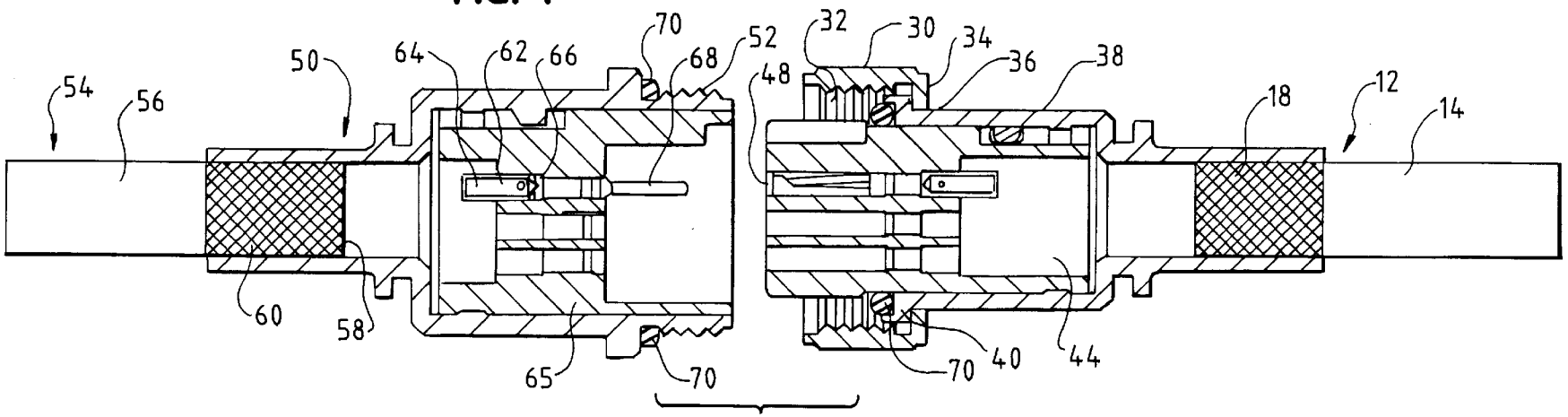
FIG. 4 is the assembled connector and cable of the present invention, showing one lead for clarity, before connection to a cable having a mating connector.

FIG. 3 and FIG. 4, on the right-hand side, show the connector 10 and the cable 12 assembled. The connector 10 is used to connect the cable 12 to another cable or to an electrical device having a mating connector 50. The mating connector 50 has a coupling mechanism such as threaded outer surface 52. Other coupling mechanisms such as a bayonet type, twist lock type, or quick disconnect exterior types may be used, consistent with the nature of the coupling mechanism associated with the connector 10. The mating connector 50 may be a standard device for cable connection, although the crimped connections of the present invention is preferred as described below.

For purposes of this description, the mating connector 50 is attached to a cable 54. For simplicity of explanation cables 12 and 54 are identical; however, the present invention may be used to connect different cables. Additionally, it is to be understood for purposes of the present invention that the cable 54 may represent the internal cabling of an electrical device and thus mating connector 50 would be an input or output plug of a device which receives or transmits electrical signals.

Similar to cable 12, cable 54 has a cable jacket 56 which surrounds a braid 58. The braid 58 is folded over the cable jacket 56 to form a braid contact surface 60. The braid surface 60 of the cable 54 is crimped into electrical contact with the mating connector 50. Cable 54 also has three signal leads 62 (only one of which is shown in FIG. 4 for clarity), each including a wire 66 surrounded by an insulation layer 64. Connector 10 serves to connect the signal leads 20 of the cable 12 to connector 50 and the signal leads 62 of the cable 54. The signal leads 62 of the cable 54 have the insulation layers 64 stripped away to expose the wires 66. Each wire 66 is soldered or otherwise connected to a corresponding pin-socket contact 68, which is provided within an insulating insert 65. The pin-socket contacts 68 mate with pin-socket contacts 48 of connector 10 to create electrical contact between the wires 66 of the cable 54 and the wires 24 of the cable 12.

As depicted in FIG. 1, the threaded outer surface 52 of the mating connector 50 is engageable with the threaded inner surface 32 of the coupling ring 30, with the coupling ring 30 being freely rotatable about the shield 38 to engage the threaded outer surface 52. Of course, when the coupling mechanisms of the connector 10 and the mating connector 50 are of the bayonet or other type, the connector 10 and the mating connector 50 are also engageable. In the embodiment shown, the interior diameter of the mating connector 50 also fits snugly over the insulating insert 44 of the connector 10. By providing the braid contact surface 60 of the cable 54 in electrical contract with the mating connector 50 using the crimping technique of the invention as discussed above, a continuous shield may be provided from the braid 16 of cable 12 through the connectors 10 and 50 to the braid 58 of cable 54. This continuous shield protects against EMI, ESD and EMC emissions, as well as provided lighting protection.

Figure 5:
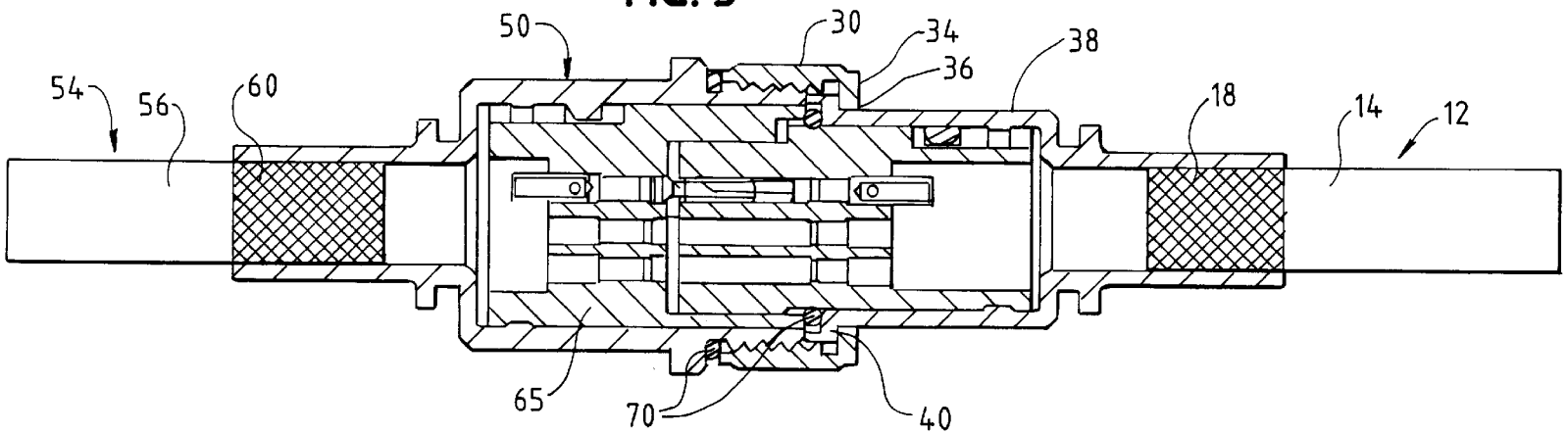
FIG. 5 is the connected assembled connector of the present invention, showing one lead for clarity, mated with the connector of FIG. 4.

The assembly of the connectors 10 and 50 will now be explained with reference to FIG. 4 and FIG. 5 which show the connector 10 mated with mating connector 50. The cables 12 and 54 are prepared to create the braid contact surfaces 18 and 60 and expose the wires 24 and 66 of the signal leads 20 and 62. After the insulating inserts 44 and 65 and corresponding contacts 48 and 68 are installed on the wires of cables 12 and 54 to secure the leads to the corresponding contacts 48 and 68, the outer components of the connectors 10 and 50 are crimped into secure 360° engagement with the braid contact surfaces 18 and 60 respectively. The coupling ring 30 is then rotated onto the exterior surface 52 of the mating connector 50. The threads of the threaded interior surface of the coupling ring 30 engage the threads of the exterior surface 52 to create a tight seal. The wave spring 42 further enhances the tight seal and electrical contact between the coupling ring 30 and the shield 38.

An optional wave spring or washer 70 may be placed around the mating connector 50 to contact the coupling ring 30. The wave spring 70 may act as an anti-vibration device and may also provide additional electrical contact between the coupling ring 30 and the mating connector 50.

The pin-socket contacts 48 and 68 are mated to create electrical contacts between the signal leads 20 and 62 of the cables 12 and 14. Electrical continuity exists from the braid surface 18 to the shield 38 to the coupling ring 30. In this arrangement, there is additional electrical continuity from the shield 38 to the coupling ring 30 via the optional wave spring 42. Thus, the shielding provided by the braid 16 is continued by the shield 38 to the mating connector 50 to the braid 58 of the cable 54. There is additional electrical continuity from the cable 12 to the mating connector 50 via the optional wave spring 70 providing constant compressive force. Additional environmental shielding may be provided by a coating over the connector 10 if desired.

It may be seen that the present invention provides for simple assembly of few components. The connector 10 requires no additional support mechanisms other than the cable 12. The connector 10 may be adapted for any diameter cable with any number of signal leads. The connector arrangement of the present invention also provides a tight environmental seal for the connection.

Figure 6:
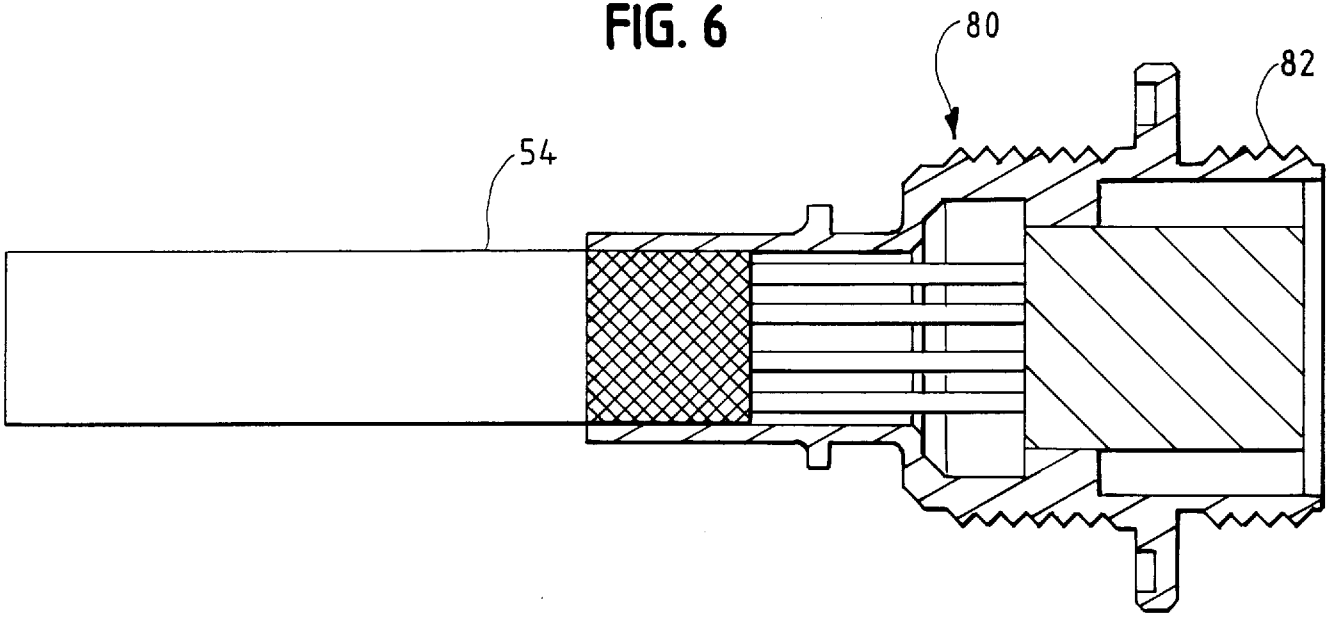
FIG. 6 is a representative embodiment of an alternate mating connector that may be used with the connector of the present invention.

The connector 10 may be used with a variety of mating connectors. For example FIG. 6 shows an alternate mating connector 80 that may be used with the connector of the present invention. The mating connector 80 is shown attached to the cable 54 in a manner as described above. Of course mating connector 80 may be an input or output plug of a device. Mating connector 80 has a threaded exterior surface 82 which is engageable with the coupling ring 30 of the connector 10.

It will be understood that modifications and variations may be effected without departing from the spirit and scope of the novel concepts of this invention.

What is claimed is:

1. A cable connector for connecting a cable to a mating connector having at least one electrical lead and an integral coupling mechanism, the cable having a cable jacket surrounding a layer of electrically-conductive material, the electrically-conductive layer including an exposed portion not covered by the cable jacket, the electrically-conductive layer surrounding at least one electrical lead having an insulting layer surrounding a wire, the cable connector comprising:

a coupling ring having an integral coupling mechanism and an interior surface placed around the cable, said coupling mechanism of said coupling ring engageable with the integral coupling mechanism of the mating connector to connect the mating connector with said coupling ring;

a tubular shield extending from said coupling ring and surrounding the cable and the exposed portion of the electrically-conductive layer; and an insulating insert placed within said shield, said insulating insert surrounding an exposed end of the at least one electrical lead of the cable;

wherein a portion of said shield is crimped to create multiple indents in secure engagement with the cable for mechanical retention and an electrical contact between said shield and the exposed portion of the electrically-conductive layer.

2. The connector of claim 1 further comprising a wave spring placed around said shield, said wave spring in electrical contact with said coupling ring and said shield.

3. The connector of claim 1 wherein said integral coupling mechanism of the mating connector is a threaded exterior surface and said coupling mechanism of said coupling ring is a threaded interior surface.

4. The connector of claim 1 wherein said shield is cylindrical in shape and said insulating insert is cylindrical in shape.

5. The connector of claim 1 wherein said shield and said coupling ring are aluminum with electroless nickel plating.

6. The connector of claim 1 wherein said insulating insert is polyurethane.

7. The connector of claim 1 wherein the at least one electrical lead of the cable is connected to the at least one electrical lead of the mating connector.

8. The connector of claim 4 wherein said coupling ring further comprises a retaining wall having an opening with a diameter sufficient to allow passage of said shield.

9. The connector of claim 8 wherein said shield further comprises a flared lip which abuts against said retaining wall.

10. The connector of claim 9 wherein said insulating insert has a stopper which abuts against said flared lip of said shield.

11. A method of fabricating a cable connector to connect a cable to a mating connector having an integral coupling mechanism, the cable having a cable jacket, a layer of electrically-conductive material surrounded by the cable jacket, and at least one electrical lead surrounded by the electrically-conductive layer, the method comprising the steps of:

removing the cable jacket from a portion of one end of the cable to expose a portion of the electrically-conductive layer;

placing the cable through a coupling ring having an integral coupling mechanism engageable with the integral coupling mechanism of the mating connector;

placing a tubular shield over the exposed portion of the electrically-conductive layer such that said shield is extending from said coupling ring;

crimping a portion of said shield to create multiple indents in secure engagement with the cable for mechanical retention and electrical contact between the shield and the exposed portion of the electrically-conductive layer; and placing an insulating insert within said shield so that an exposed end of the at least one electrical lead of the cable is contained within the insulating insert.

12. The connector of claim 1, wherein the coupling ring and the shield are separate members.

13. The connector of claim 1, wherein the electrically-conductive layer is a braid.

14. The connector of claim 1, wherein the exposed portion of the electrically-conductive layer is folded over the cable jacket.

15. The connector of claim 1 further including an electrical contact member located within the insulating insert and provided in electrical communication with the exposed end of the at least one electrical lead.

16. The method of claim 11 further including the step of folding the exposed portion of the electrically-conductive layer over the cable jacket prior to placing the shield thereover.

17. A cable connector for connecting a cable to a mating connector having at least one electrical lead and an integral coupling mechanism, the cable having a cable jacket surrounding a layer of electrically-conductive material, the electrically-conductive layer including an exposed portion not covered by the cable jacket, the electrically-conductive layer surrounding at least one electrical lead having an insulating layer surrounding a wire, the cable connector comprising:

a coupling ring having an integral coupling mechanism and an interior surface placed around the cable, said coupling mechanism of said coupling ring engageable with the integral coupling mechanism of the mating connector to connect the mating connector with said coupling ring, said coupling ring further including a retaining wall with an opening therethrough;

a tubular shield extending through the opening in the retaining wall of said coupling ring and surrounding the cable and the exposed portion of the electrically-conductive layer, said shield including a flared lip abutting against the retaining wall;

an insulating insert place within said shield, said insulating insert surrounding an exposed end of the at least one electrical lead of the cable, said insulating insert including a stopper abutting against the flared lip of the shield;

wherein a portion of said shield is crimped into engagement with the cable to create an electrical contact between said shield and the exposed portion of the electrically-conductive layer.

* * * * *

UNITED STATES PATENT AND TRADEMARK OFFICE

CERTIFICATE OF CORRECTION

PATENT NO. : 5,823,803
DATED : October 20, 1998
INVENTOR(S) : Brian c. Majors

It is certified that error appears in the above-identified patent and that said Letters Patent is hereby corrected as shown below:

Column 5, line 26, change "provided lighting" to –providing lightning--.

Signed and Sealed this

Eighteenth Day of May, 1999

*Attest:*

Q. TODD DICKINSON

*Attesting Officer*

*Acting Commissioner of Patents and Trademarks*